US007677564B2

(12) United States Patent
Kriger

(10) Patent No.: US 7,677,564 B2
(45) Date of Patent: Mar. 16, 2010

(54) SUDOKU-TYPE PUZZLE BOARD GAME AND METHOD OF PLAY

(76) Inventor: Marc Kriger, 7683 SE. 27th, #258, Mercer Island, WA (US) 98040

( * ) Notice: Subject to any disclaimer, the term of this patent is extended or adjusted under 35 U.S.C. 154(b) by 41 days.

(21) Appl. No.: 11/888,659

(22) Filed: Jul. 31, 2007

(65) Prior Publication Data

US 2008/0054562 A1 Mar. 6, 2008

Related U.S. Application Data

(63) Continuation-in-part of application No. PCT/US2007/002326, filed on Jan. 26, 2007.

(60) Provisional application No. 60/762,437, filed on Jan. 26, 2006.

(51) Int. Cl.
*A63F 9/00* (2006.01)

(52) U.S. Cl. ..... 273/148 R; 273/238; 273/240; 273/153 R

(58) Field of Classification Search ..... 273/153 R, 273/269, 270, 237, 238, 263, 265, 287; 434/327, 434/334, 335, 339, 340, 357, 360, 361, 363, 434/177, 364
See application file for complete search history.

(56) References Cited

U.S. PATENT DOCUMENTS 2,470,310 A * 5/1949 Heyman ..... 273/269
2,757,933 A * 8/1956 Gilmour ..... 273/254
RE24,409 E 12/1957 Withers
2,892,267 A * 6/1959 Harvey ..... 434/208
3,319,359 A * 5/1967 Rosenfield ..... 434/360
3,787,988 A 1/1974 Nakajima et al.
3,893,671 A 7/1975 Gardner
3,947,978 A * 4/1976 Clark et al. ..... 434/339
4,126,315 A 11/1978 Tung
4,165,878 A * 8/1979 Frain ..... 273/240

(Continued)

OTHER PUBLICATIONS

"Electronic Sudoku," http://www.just60.com/xq/ASP/ID.908/t.Electronic%20Sudoku/qx/i_product_page.htm, downloaded Sep. 20, 2005.

(Continued)

*Primary Examiner*—William M Pierce
(74) *Attorney, Agent, or Firm*—Seed IP Law Group PLLC

(57) ABSTRACT

A game apparatus is provided for one or more players having a first game member that includes a puzzle or a game area having indicia forming a grid having sub-grids including a plurality of cells. Each cell is assigned indicia in a solution pattern of the puzzle such that a distinct indicia appears once in each row, column, and sub-grid. The first game member displays the solution indicia for some of the cells and the remaining cells are divided into a number of sub-cells bearing the possible solution indicia for the corresponding cell such that each sub-cell includes a distinct indicia. A player speculates which sub-cell bears the correct solution indicia for the respective cell. The apparatus further includes at least one game piece adapted to randomly display an indicia when manipulated, the indicia modifying a game parameter such as a player's score or number of possible speculations the player can make in one turn.

17 Claims, 15 Drawing Sheets

U.S. PATENT DOCUMENTS

| | | | | | |
|---|---|---|---|---|---|
| 4,275,442 | A | | 6/1981 | Underwood et al. | |
| 4,369,973 | A | | 1/1983 | D'Aurora et al. | |
| 4,522,599 | A | * | 6/1985 | Harte | 434/339 |
| 4,561,852 | A | * | 12/1985 | Harte | 434/339 |
| 4,565,373 | A | | 1/1986 | Ungar | |
| 4,615,527 | A | | 10/1986 | Moss | |
| 4,801,148 | A | | 1/1989 | Lamb | |
| 4,852,268 | A | * | 8/1989 | Sutherland et al. | 33/562 |
| 5,031,918 | A | | 7/1991 | Brill | |
| 5,120,226 | A | * | 6/1992 | Tsai | 434/195 |
| 5,121,926 | A | | 6/1992 | Pfaender | |
| 5,330,358 | A | * | 7/1994 | Narayanan | 434/340 |
| 5,752,701 | A | * | 5/1998 | Kao | 273/269 |
| 5,772,208 | A | | 6/1998 | McTaggart | |
| 5,871,210 | A | | 2/1999 | Harrison | |
| 6,378,867 | B1 | | 4/2002 | Shalless | |
| 7,390,237 | B2 | * | 6/2008 | Lin | 446/118 |

OTHER PUBLICATIONS

Hanssen Sudoku Worksheet (Vegard Hanssens hjemmeside), http://www.menneske.no/sudokuto/eng/3x3.html, downloaded Mar. 21, 2008.

"Solving Sudoku," http://www.angusi.com/sudoku/hints.php, downloaded Sep. 18, 2005.

"Sudoku Board Game puzzle of Jul. 23, 2005," www.sudokucentral.com, downloaded Nov. 10, 2007.

"Sudoku Board game puzzle solution of Jul. 25, 2005," www.sudokucentral.com, downloaded Nov. 10, 2007.

"Sudoku Central," Daily Sudoku Puzzle for May 9, 2006, http://www.sudokucentral.com/puzzle-archive/20060509, downloaded Mar. 21, 2008.

"Sudoku Rules," Su-doku Selection Magazine, 2005, www.winningmoves.com.

"Solution Table,", Sudoku puzzles, http://web.archive.org/web/20051027060006/www.menneske.no/sudoku/eng/solutiongrod.html, downloaded Mar. 21, 2008.

"Carol Vorderman's Sudoku Board Game," http://www.drumondpark.com/rules/vordermansudoku.html, downloaded Sep. 20, 2005.

"Winning Moves," http://www.winningmoves.co.uk/gamview.asp?ID=152, downloaded Sep. 20, 2005.

* cited by examiner

| | | | | | | | | |
|---|---|---|---|---|---|---|---|---|
| 1 | 7 | 5 | 2 | 9 | 4 | 3 | 8 | 6 |
| 9 | 6 | 3 | 1 | 5 | 8 | 2 | 7 | 4 |
| 2 | 8 | 4 | 7 | 3 | 6 | 9 | 1 | 5 |
| 5 | 3 | 9 | 6 | 7 | 2 | 1 | 4 | 8 |
| 7 | 2 | 1 | 4 | 8 | 3 | 5 | 6 | 9 |
| 8 | 4 | 6 | 9 | 1 | 5 | 7 | 2 | 3 |
| 3 | 1 | 8 | 5 | 6 | 7 | 4 | 9 | 2 |
| 4 | 5 | 7 | 8 | 2 | 9 | 6 | 3 | 1 |
| 6 | 9 | 2 | 3 | 4 | 1 | 8 | 5 | 7 |

SUDOKU-TYPE PUZZLE BOARD GAME AND METHOD OF PLAY

BACKGROUND

1. Field

The present invention relates to games that involve logic-based puzzles and, more specifically, to a board game and method of play that includes conversion of a solitaire numeric puzzle game to a multiplayer game of completing number patterns initiated by a given set of numbers.

2. Description of the Related Art

A variety of games and puzzles have been introduced that involve numbers and their logical arrangement in specific patterns based on a set of rules. Typically these puzzles have a solution pattern that a player develops based on the relationship of the numbers in certain locations on a grid. Many of these puzzles are solitaire games, allowing only one player to enjoy completing the logic-based pattern of numbers. In some cases, number puzzles are evolved variations of ancient games based on certain mathematical rules. A particular game, Su Doku (also referred to as Sudoku, Soduku, Suduku, and Su Duku) is a solitaire puzzle involving ordered rows and columns of numbers. Both puzzle aficionados and others generally interested in logic have exhibited increasing interest in playing Su Doku.

Rules of play for numeric games such as Su Doku are generally rooted in the rules for Latin Squares, a game dated as far back as the thirteenth century. Latin Squares puzzles are solitaire puzzles that include a grid of cells formed by columns and rows and a set of numbers or symbols, each appearing once in each row and column of the solution pattern. Su Doku is an evolved version of Latin Squares having nine columns and nine rows forming a grid of eighty-one cells. Each cell in the solution pattern is assigned a number from 1 to 9 and each number appears only once in any given row or column. The cells are further divided into groups of nine cells, each group forming sub-grids having three columns and three rows. In the solution pattern, each cell in the respective sub-grids is assigned a distinct number from one to nine, each number appearing only once in any given sub-grid. Typically, the puzzles provide the solution numbers for some of the cells and the player has to develop the rest based on the numbers provided. The number of cells in the puzzle with the solution numbers provided determines the difficulty of a given Su Doku Puzzle.

A common strategy for developing the numbers is to write all the numbers, one to nine, in each cell of the Su Doku puzzle and determine the solution numbers in each cell by a process of elimination. Using this strategy, a player denotes unselected numbers in each cell by crossing them out. Although this strategy is an effective method of determining the solution numbers, it can result in a cluttered playing area. For example, a number may have to be rewritten in a cell next to where it was crossed out because it was crossed out in error. A number may be crossed out in error when that number was selected as a solution number in error in the corresponding row, column or sub-grid. Additionally when the puzzle is partially developed and there is numerous crossed-out numbers on the playing area, it becomes difficult to distinguish which cells remain to be filled with a number and which numbers remain available as solution numbers.

Furthermore, similar to their predecessors, recent games such as Su Doku are generally solitaire games, allowing only one person to play the game. Typically these puzzles remain on paper and the player must use a writing instrument to solve the puzzles. Certain variations of Su Doku accommodate more than one player and provide other means of playing the game such as a single board and numbered game pieces or felt pens and an erasable playing area. However, such variations are typically limited to either two or four players and do not provide for a more cohesive way of executing the process of elimination strategy described above. Therefore, these variations simply provide an enlarged version of the original game.

Although number puzzles such as Su Doku can be entertaining and intellectually challenging, they remain substantially unchanged from their primitive origins and are limited in the number of players that can simultaneously play against each other in one game. Furthermore, existing tools for playing such games impose obstacles that inhibit execution of strategies to solve the puzzles expediently. Therefore, there is a need for a number puzzle and/or game that allows an unlimited number of players to play against one another and that is configured to accommodate effective execution of strategies.

BRIEF SUMMARY

One embodiment of the present invention provides an apparatus for playing a board game including a playing plane having a master grid with a plurality of cells formed by columns and rows, wherein the master grid is subdivided into sub-grids, each sub-grid having a number of cells equal to the number of columns in the master grid, each cell divided into a number of sub-cells equal to the number of columns in the master grid, and each sub-cell assigned a distinct indicia, the total number of distinct indicia equal to the number of columns in the master grid; a solution plane having a plurality of cells corresponding to respective cells of the playing plane and configured to provide an indication of correctness of a user-proposed solution; and at least a first game piece carrying at least two distinct indicia and adapted to randomly display at least one distinct indicia in response to a manipulation of the first game piece for providing an indication of a first rule of play applicable to a first game parameter of a current player.

In accordance with another embodiment, a method of game play for one or more players, using a game apparatus having at least a first game piece carrying at least two distinct indicia and configured to randomly display at least one distinct indicia in response to a manipulation of the first game piece, predetermined solution indicia corresponding to a cell on a playing plane having a master grid with a plurality of cells formed by an equal number of columns and rows, wherein the master grid is subdivided into sub-grids, each sub-grid having a number of cells equal to the number of columns in the master grid, each cell divided into a number of sub-cells equal to the number of columns in the master grid, and each sub-cell assigned a distinct indicia, the total number of distinct indicia equal to the number of columns in the master grid wherein one solution sub-cell per cell is assigned an indicia that is the predetermined solution indicia for the corresponding cell of the playing plane and each solution indicia occurs once in each sub-grid, row and column of the master grid. The method includes a player manipulating the first game piece to randomly display at least one of the distinct indicia carried by the first game piece; the current player selecting at least one sub-cell on the playing plane; the current player revealing a signal on a solution plane having a plurality of sub-cells, respectively corresponding to the selected sub-cell of the playing plane; and tallying points received during play for each player as selection of the solution sub-cells associated with the solution indicia assigned to the corresponding cell wherein the player with the highest points is the winner and at least one of the selecting the at least one sub-cell and tallying the points is subject to a first rule of play indicated by the randomly displayed indicia of the first game piece.

BRIEF DESCRIPTION OF THE SEVERAL VIEWS OF THE DRAWING(S)

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with controllers, illumination devices, audible devices, fiber optics, data storage devices and display devices, including but not limited to voltage and/or current regulators, light emitting diodes (LED), piezo speakers, fiber optic pins, integrated and/or removable memory media, and liquid crystal displays (LCD) have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
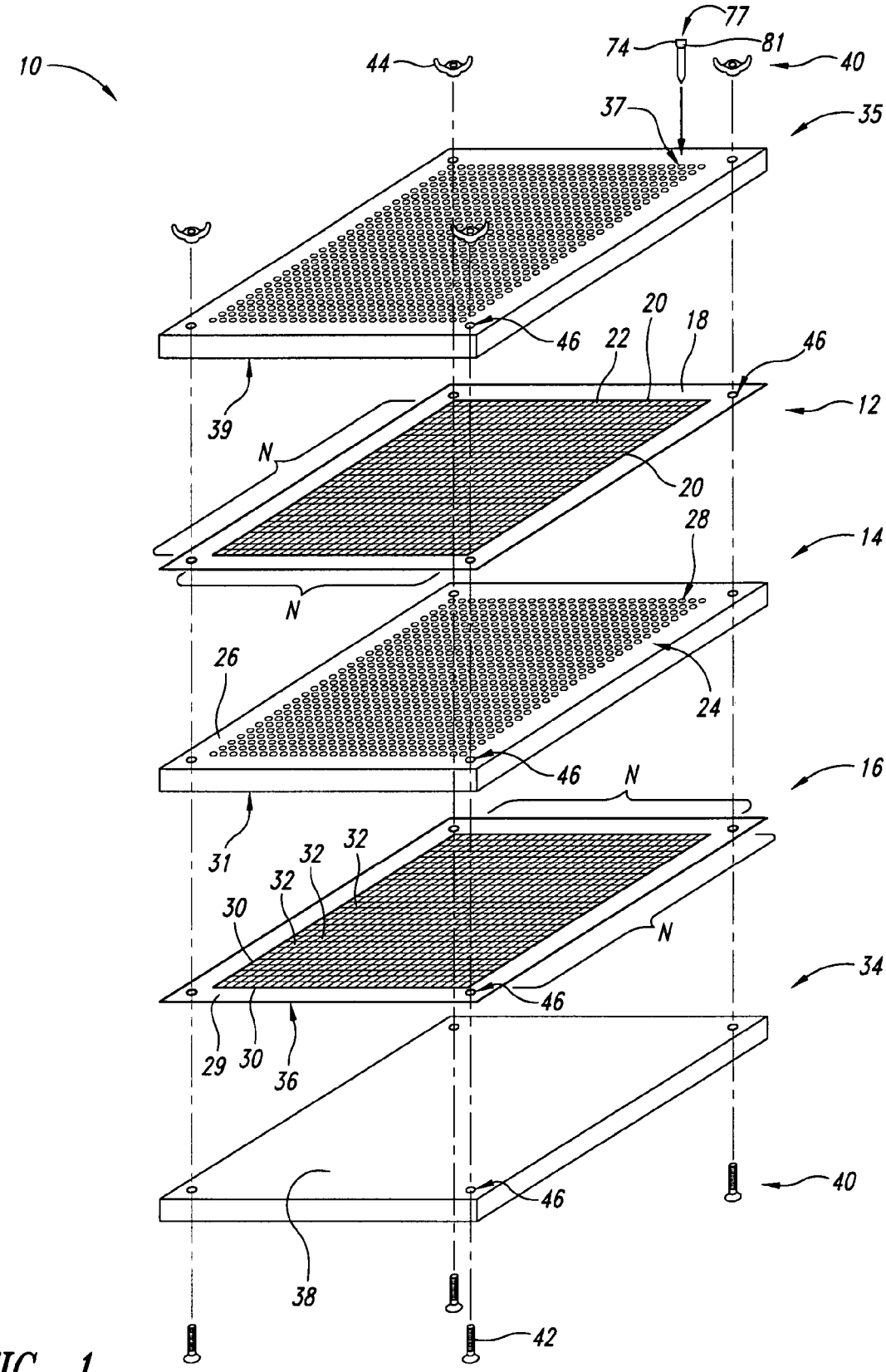
FIG. 1 is an exploded isometric view of a game apparatus according to an embodiment of the present invention including a first game member, a second game member, and a third game member.

In one embodiment of the present invention as illustrated in FIG. 1, a game apparatus 10 is provided including a first game member 12, a second game member 14, and a third game member 16. The first game member 12 includes a first surface 18 having indicia forming a master grid 20. The master grid 20 includes an equal number N of rows and columns forming a plurality of cells 22. The second game member 14 includes a first plate 24 that can support the first game member 12 on a first surface 26 thereof. The plate 24 also includes a plurality of openings 28 described in more detail below.

The third game member 16 includes a first surface 29 having indicia forming a master grid 30. The master grid 30 includes an equal number N of rows and columns forming a plurality of cells 32. The first surface 29 of the third game member 16 can be positioned against a second surface 31 of the second game member 14, for example when the second game member 14 rests on the third game member 16.

The game apparatus 10 may include an optional substrate member 34, supporting a second surface 36 of the third game member 16 on a first surface 38 of the substrate member 34, for example when the third game member 16 rests on the substrate member 34. Additionally, or alternatively, the game apparatus 10 may include at least one optional fastening member 40, for example a threaded screw 42 and a wing nut 44 as shown in FIG. 1. The threaded screws 42 may extend through corner apertures 46 and threadedly fasten to the wing nuts 44, securing the game members 12, 14, 16.

The game members 12, 14, 16 can also be secured using other methods such as, but not limited to, adhesives between the mating surfaces, at least one clamp, joint welds in embodiments in which the members 12, 14, 16 are weldable, hook and loop fasteners mounted on the mating surfaces, or any other fastening or securing mechanism, device, or method capable of securing the game members 12, 14, 16 in a manner that preferably allows disassembly.

Additionally, or alternatively, the game apparatus 10 may include an optional cover member 35 having a plurality of openings 37 alignable with the plurality of openings 28 in the plate 24, and at least one corner aperture 46 through which the threaded screw 42 may extend to fasten to the wing nut 44. A first surface 39 of the cover member 35 may rest on the first surface 18 of the first game member 12, for example when the game apparatus 10 is assembled.

Figure 2:
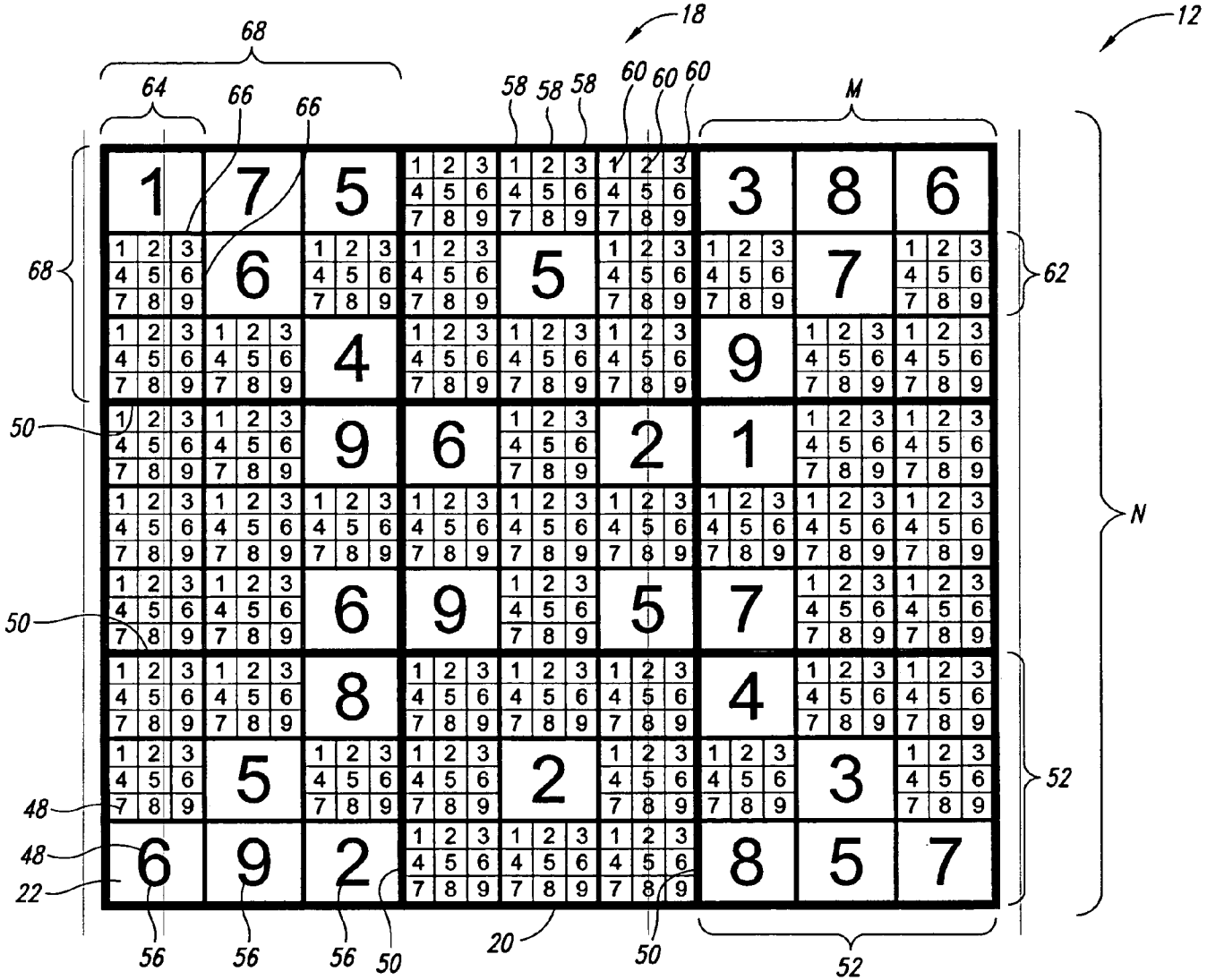
FIG. 2 is a plan view of the first game member of FIG. 1.

Referring to FIG. 2, the cells 22 of the first game member 12 include at least one indicia 48 that can be a symbol, a letter, a number, or any other indicia that is distinctly identifiable. The cells 22 are grouped by grid lines 50 into sub-grids 52 of cells 22, such that each sub-grid 52 includes an equal number M of rows and columns, respectively, equal to a square-root of the number N of columns or rows of the master grid 20. In the illustrated embodiment of FIG. 2, groups of nine cells 22 form sub-grids 52 of three rows and three columns. The first surface 18 of the first game member 12 having master grid 20, forms a playing area such as a puzzle surface for players to manipulate and solve the puzzle.

Figure 3:
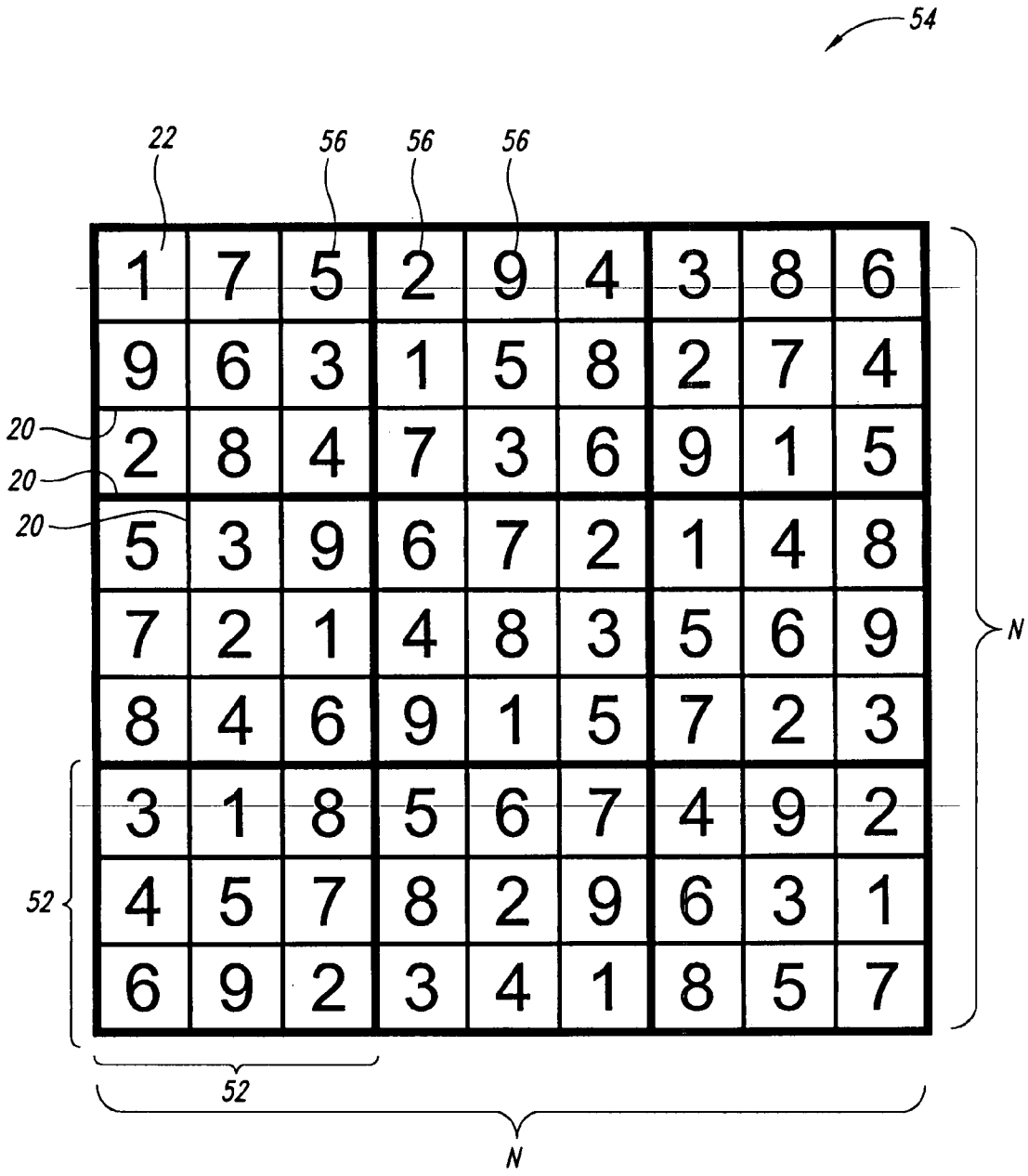
FIG. 3 is a solution pattern for a puzzle of the first game member of FIG. 2.

As illustrated in FIG. 3 a solution of the puzzle can be a solution pattern 54 of solution indicia 56, such as, but not limited to numbers, with a solution indicia 56 assigned to each respective cell 22. Rules of play include that the quantity of distinct solution indicia 56 is equal to the number N of rows or columns of the master grid 20. The rules further include that each distinct solution indicia 56 may appear only once in each sub-grid 52 and in each row and column of the master grid 20.

As illustrated in FIG. 2, the numeric indicia 48 in at least one of the cells 22 may display the corresponding solution indicia 56 that is assigned to that cell 22 in the solution pattern 54 (FIG. 3). The displayed solution indicia 56 in the master grid 20 of the first game member 12 provide clues to at least one player to use and develop the remaining solution indicia 56 in the remaining cells 22. The remaining cells 22 that do not display the corresponding solution indicia 56, are further divided into a number N of cells or sub-cells 58 equal to the number N of rows or columns in the master grid 20. These remaining cells 22 display all the possible solution indicia 56 in sub-cells 58, respectively, such that each sub-cell 58 includes a distinct indicia 60.

In the exemplary embodiment of FIG. 2, there are nine rows and nine columns in the master grid 20 and the solution indicia 56 are numbers. Therefore, the solution indicia 56 range from a first number, 1, to a second number, 9, preferably displayed in Arabic numerals. Each cell 22 that does not display the corresponding solution indicia 56 from the solution pattern 54 (FIG. 3), is divided into nine sub-cells 58, each including a distinct indicia 60 from the group of solution indicia 56, which range from the number, 1, to the number, 9, as illustrated in FIG. 3.

The indicia 60 in the sub-cells 58 allow a player to visually compare the displayed solution indicia 56 provided as clues and eliminate these indicia or numbers from the list of available solution indicia 60 included in the sub-cells 58. Therefore, the player can develop the solution indicia 56 for each cell 22 by a process of elimination.

For example in FIG. 2, a second row 62 displays numbers 6, 5 and 7 as given solution indicia 56 in respective cells 22. Further, a first column 64 displays numbers 1 and 6 as the solution indicia 56 in respective cells 22. Therefore, if a player is trying to determine the solution indicia 56 corresponding to a cell 66 formed by the intersection of the second row 62 and the first column 64, that player can eliminate the numbers 1, 5, 6, and 7 from the potential solution numbers 60 in the corresponding sub-cells 58 of the cell 66.

Furthermore, a sub-grid 68 to which the cell 66 belongs displays the numbers 1, 4, 5, 6, and 7 as the given solution indicia 56 in the respective cells 22. Therefore, the player can also eliminate an additional number, 4, from the potential solution numbers 60 in the cell 66 because the rules of play include that each distinct solution indicia 56 may appear only once in a sub-grid 52, 68. Therefore, the player can narrow his choice for the solution indicia 56 assigned to the cell 66, from nine possible numbers 60 to four possible numbers 60, namely, the numbers 2, 3, 8, and 9.

Figure 4:
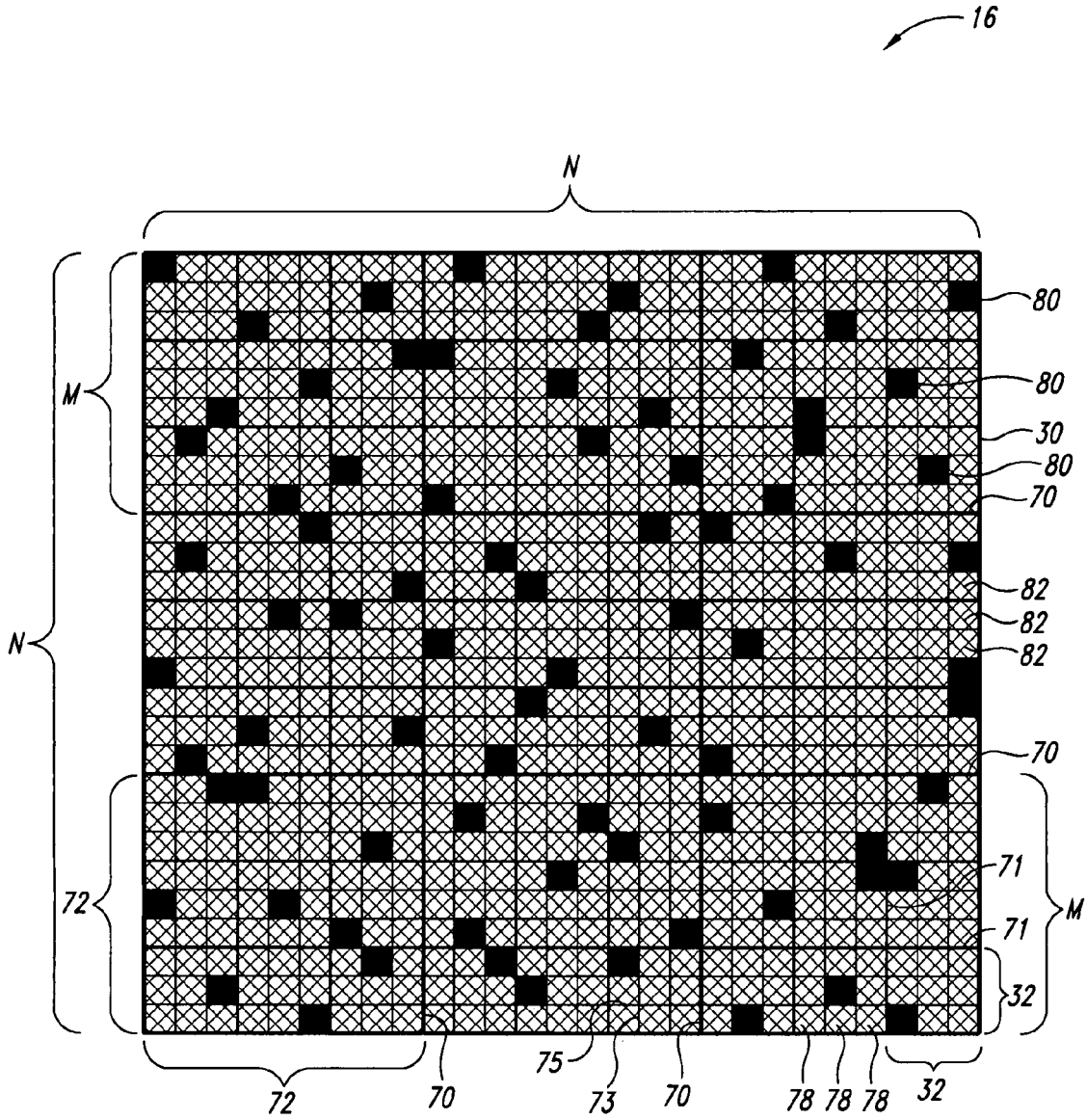
FIG. 4 is a plan view of the third game member of FIG. 1.

In FIG. 4, the third game member 16 includes a master grid 30 (FIG. 1) having cells 32 defined by grid lines 71 that are grouped into larger sub-grids 72 by grid lines 70. Each cell 32 is divided by vertical grid lines 73 and horizontal grid lines 75 into sub-cells 78. Each sub-grid 72 includes an equal number M of columns and rows, respectively, equal to a square root of the number N of the columns or rows of the master grid 30. In the illustrated embodiment of FIG. 4, the cells 32 are grouped by grid lines 70 into groups of nine cells 32, forming the sub-grids 72 of three rows and three columns. Each sub cell 78 includes either first indicia 80 or second indicia 82. The first indicia 80 indicates a correct selection while the second indicia 82 indicates an incorrect selection.

Referring back to FIG. 1, the game apparatus 10 may further include at least one tool 74 for selecting the sub-cells 58 of the first game member 12 corresponding to an indicia 60 such as, but not limited to, a numeric indicia, which a current player (i.e., a player whose turn it is to play) selects as the solution indicia 56 assigned to the corresponding cell 22 in the solution pattern 54 (FIG. 3). The first game member 12 can be fabricated from a penetrable or puncturable material such as paper, cardboard, plastic, composites, any combination thereof, or any of these materials or any combination thereof that is perforated, or any other material or configuration that allows a player to puncture or penetrate the first game member 12 through the sub-cells 58.

Furthermore, the cover member 35 and the second game member 14 can be fabricated from transparent or translucent material such as glass, plastic, crystal, acrylic, silicone, or any other transparent or translucent material. Therefore, the cover member 35 does not conceal the first game member 12. Similarly, the second game member 14 does not conceal the third game member 16. Upon assembly of the game apparatus 10, the plurality of openings in the cover member 35 are substantially aligned with the sub-cells 58 of the first game member 12, the plurality of openings 28 in the plate 24 of the second game member 14, and the sub-cells 78 of the third game member 16.

The tool 74 can be configured to project through the cover member 35 and puncture the first game member 12, and to extend at least partially through the second game member 14. Therefore, the current player selects a sub-cell 58 of the first game member 12 by inserting the tool 74 through an opening 37 aligned with an indicia 60 in a sub-cell 58 of the first game member 12, the player selecting the indicia 60 to be the solution indicia 56 for the corresponding cell 22. Upon inserting the tool 74 through the opening 37 of the cover member 35, the tool 74 punctures the corresponding sub-cell 58 of the first game member 12 and proceeds through the corresponding opening 28 of the second game member 14. Upon removing the tool 74, the underlying indicia 80, 82 of the corresponding sub-cell 78 of the third game member 16 can be viewed through the punctured opening.

Revealing of the first indicia 80 of the third game member 16 indicates that the current player has made a correct selection and that player receives points and repeats the above process to speculate the solution indicia 56 of the solution pattern 54 illustrated in FIG. 3 for another cell 22 of the first playing member 12. Revealing of the second indicia 82 of the third game member 16 indicates that the current player has made an incorrect selection and another player takes a turn at speculating the solution indicia 56 of the solution pattern 54 illustrated in FIG. 3 for any cell 22 of the first game member 12. In the case of a solitaire game, the player continues speculating about which indicia 60 is the solution indicia 56 for the respective cells 22 to solve the rest of the puzzle.

Therefore, the game apparatus 10 eliminates clutter on the playing area that is common when playing existing number puzzles and/or games. The apparatus 10 further provides clear visual indications, showing which cells 22 remain to be solved and which sub-cell indicia 60 remain as choices for the solution indicia 56 for the respective cells 22. Additionally, the apparatus 10 does not limit the number of players while still accommodating a player to play a solitaire game.

Upon developing the solution pattern 54 of the puzzle of the first game member 12, a new puzzle or game may be played by removing the first and the third game members 12, 16 and replacing them with new game members 12, 16 that include a new puzzle and a new pattern of correctness indicia, respectively.

Figure 5:
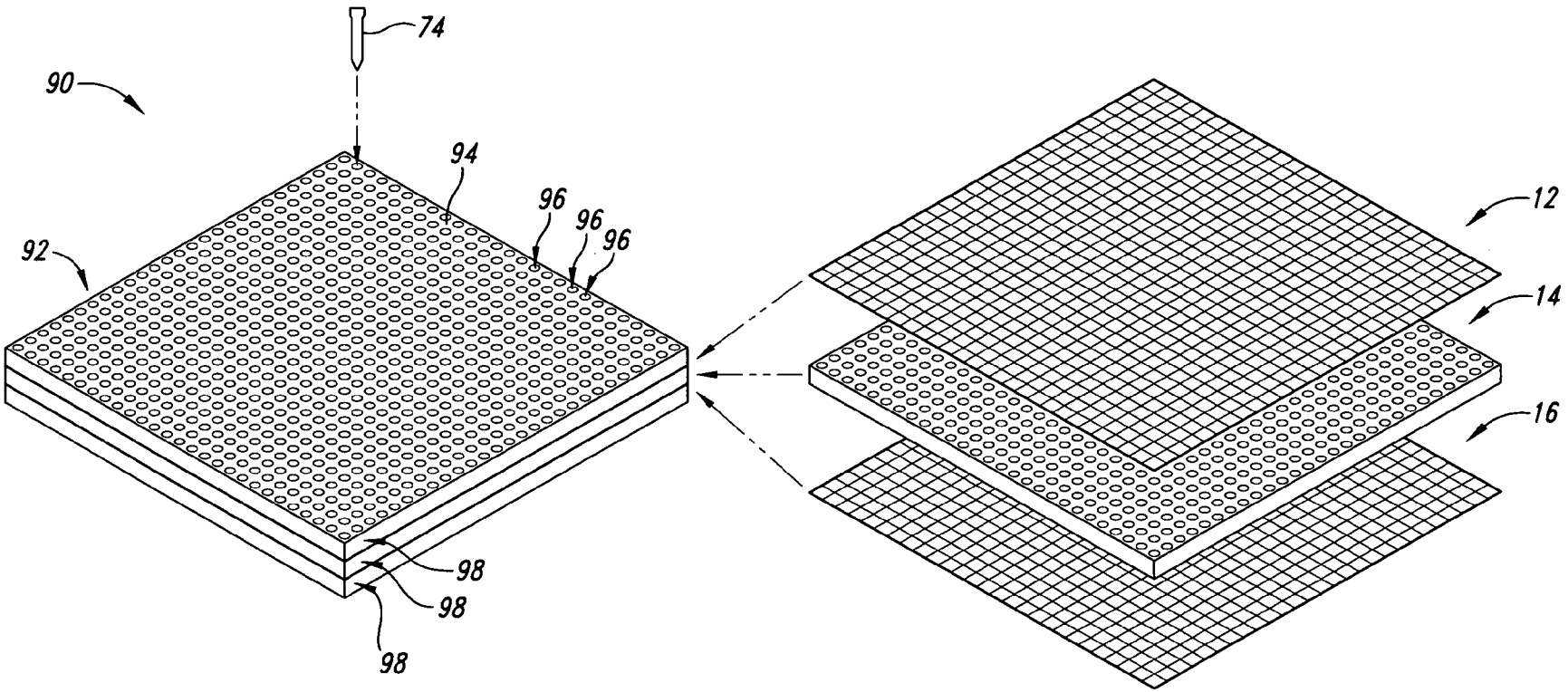
FIG. 5 is an isometric view of a game apparatus according to another embodiment of the present invention.

It will be understood that other embodiments of the present invention may or may not include all of the above components, or may include additional components. For example, in an embodiment as shown in FIG. 5, a game apparatus 90 can preclude the fastening member 40, the substrate member 34, and the cover member 35. Furthermore, the game apparatus 90 may include a housing 92 having a first surface 94. At least the first surface 94 of the housing 92 includes a plurality of openings 96 and is fabricated from a transparent material such as glass, plastic, crystal, acrylic, silicone, or any other transparent or translucent material. The housing 92 also forms a plurality of slots 98 on a side of the housing 92. The slots 98 are adapted to slidably receive the first, second, and third game members 12, 14, 16.

In such an embodiment, players may use the tool 74 and rules of play as described above to develop the solution pattern 54 (FIG. 3). Upon completing the solution pattern 54, a new game may commence after slidably removing the first and third game members 12, 16 and replacing them with new game members 12, 16 bearing new numeric or symbolic indicia 48 of the first game member 12 and correctness indicia 80, 82 of the third game member 16, respectively.

Figure 6:
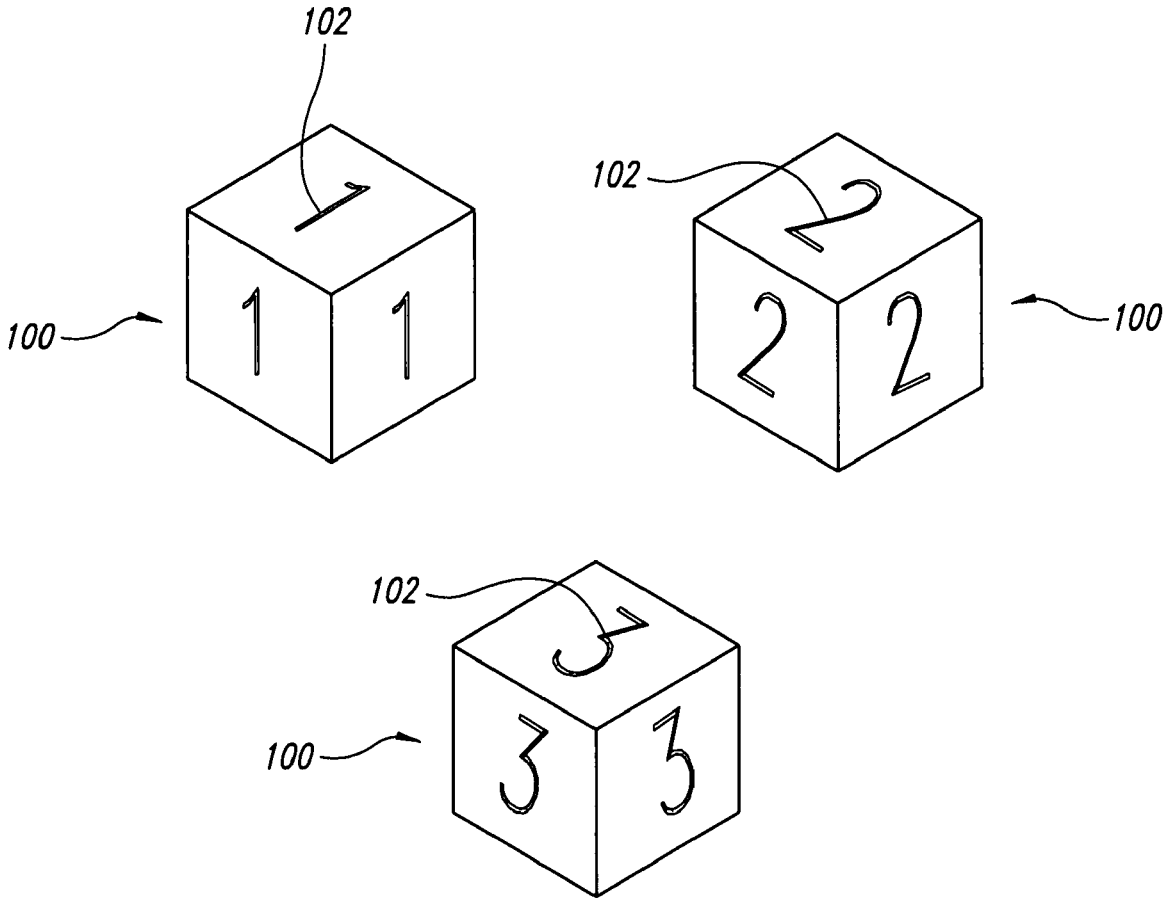
FIG. 6 is an isometric view of a plurality of optional game pieces.

As illustrated in FIG. 6, the game apparatus 10, 90 may further include optional game pieces 100 having indicia 102 substantially identical to the numbers or symbols included in the solution pattern 54 (FIG. 3). After a player makes a correct selection, the game piece 100, bearing indicia 102 corresponding to the solution indicia 56 for the respective cell 22, may be positioned on that cell 22. The game pieces 100 make it easier for players to identify the cells 22 for which the correct solution indicia 56 has been selected and to use these numbers as additional clues to develop the solution indicia 56 for the remaining cells 22.

Figure 7:
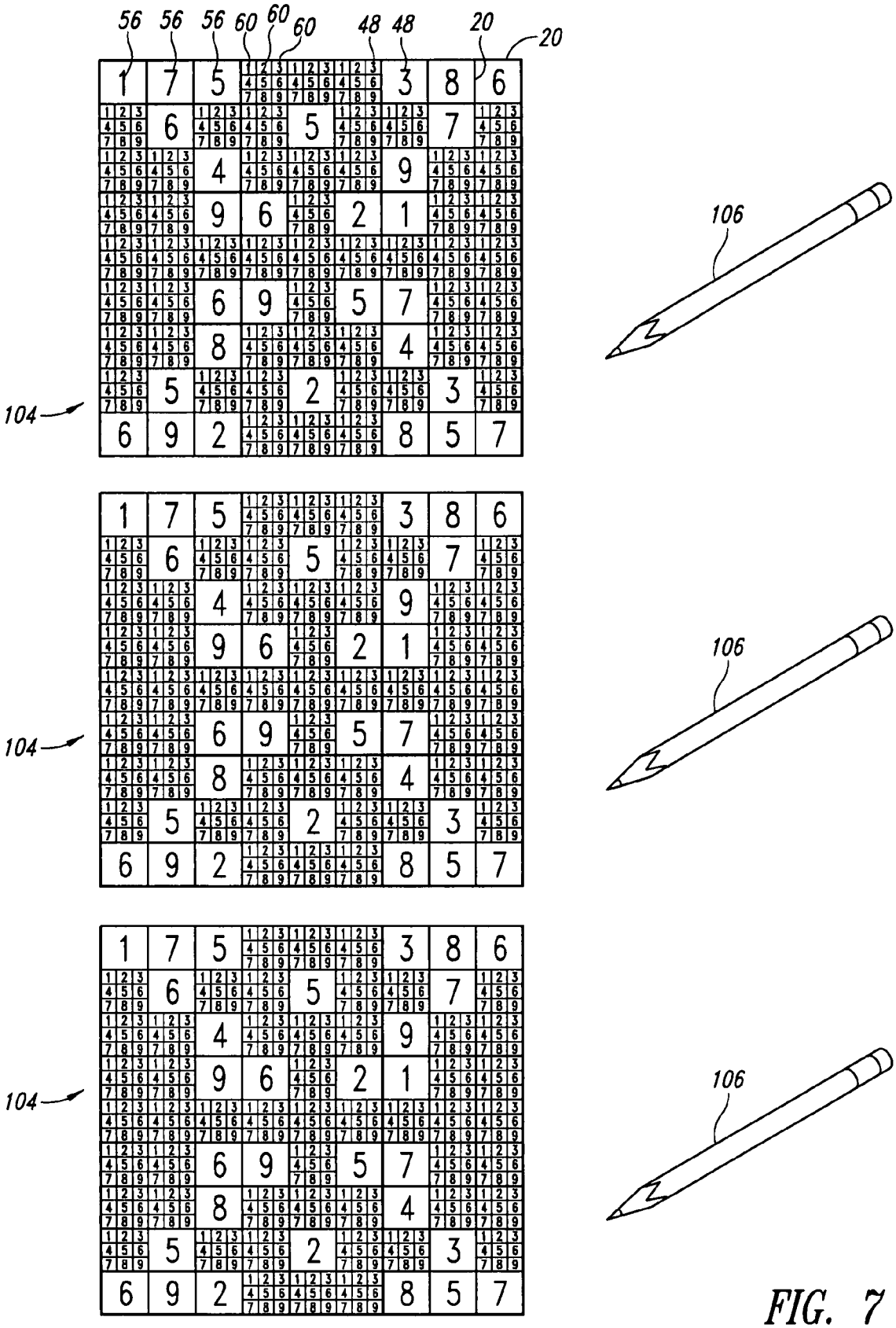
FIG. 7 is a front view of a plurality of game sheets and an isometric view of a plurality of writing tools.

As shown in FIG. 7, the game apparatus 10, 90 may also include a plurality of optional writing tools 106 and game sheets 104 having indicia substantially similar to the indicia on the first surface 18 of the first game member 12, including the master grid 20, indicia 48, given solution indicia or symbols 56, and potential solution indicia or symbols 60. The game sheets 104 are generally smaller than the first game member 12 and at least one game sheet 104 is provided for each player to monitor the progress of a game and plan future selections.

Figure 8:
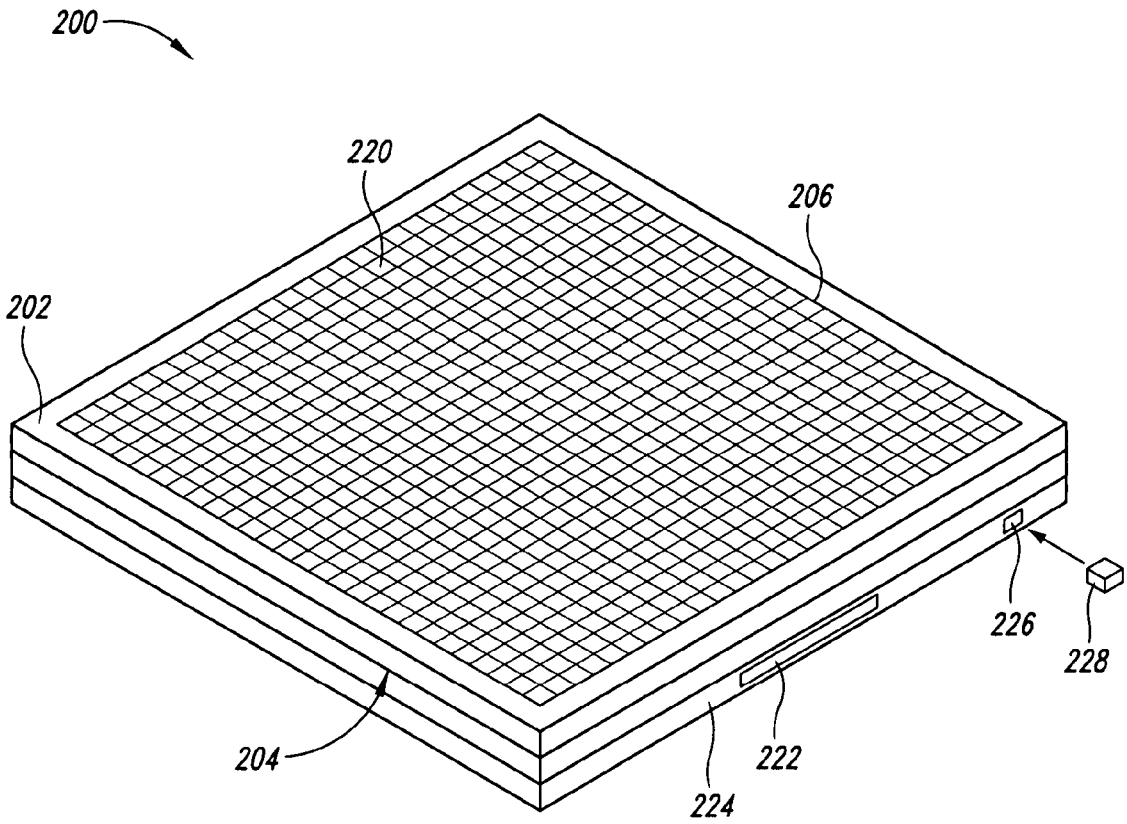
FIG. 8 is an isometric view of a game apparatus according to yet another embodiment of the present invention including a playing plane and a solution plane.
Figure 9:
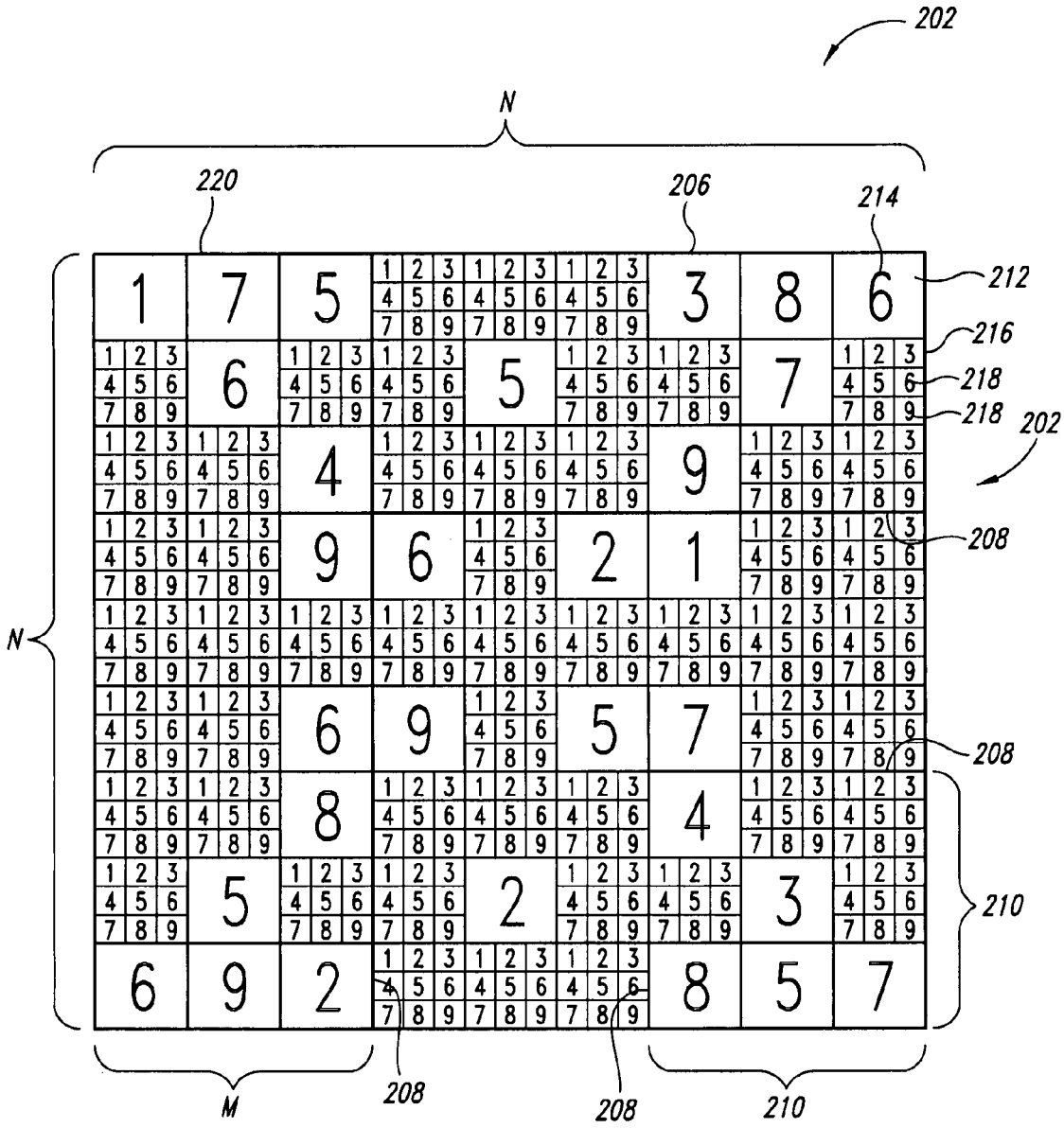
FIG. 9 is a plan view of the playing plane of FIG. 8.

In an electronic embodiment of the present invention as illustrated in FIG. 8, a game apparatus 200 is provided that includes a playing plane 202 and a solution plane 204. The playing plane 202 includes a master grid 206. As illustrated in FIG. 9, the master grid 206 includes an equal number N of rows and columns and is divided by grid lines 208 into sub-grids 210 of an equal number M of rows and columns equal to a square-root of the number N of rows or columns of the master grid 206. The rows and columns of the master grid 206 form cells 212. Some of the cells 212 include indicia 214, such as but not limited to numeric indicia, indicating the solution indicia 56 (FIG. 3) of the solution pattern 54 (FIG. 3) corresponding to the respective cells 212. Similar to the embodiments above, the given solution indicia 214 provide clues for players to develop the rest of the cells 212.

The cells 212 that do not include a solution indicia 214 in the playing plane 202 are further divided into a number N of cells or sub-cells 216 equal to the number of rows or columns of the master grid 206. The sub-cells 216, each include a distinct indicia 218, such as, but not limited to, a numeric indicia, such that as a group, the indicia 218 represent all the possible choices for the solution indicia 56 assigned to the corresponding cell 212 in the solution pattern 54.

As illustrated in FIG. 8 and FIG. 9, the playing plane further includes a display device 220 such as, but not limited to, a liquid crystal display (LCD). The display device 220 can display the numeric indicia 214 and the possible solution numbers 218. This information may be obtained from pre-programmed puzzle templates in a storage device 222 housed in a substrate member 224. In other embodiments, the storage device 222 may be externally located with respect to the game apparatus 200 (not shown).

Additionally, or alternatively, as illustrated in FIG. 8 the game apparatus 200 may include at least one port 226 for receiving at least one data storage medium 228 such as, but not limited to, compact disks, floppy disks, flash memory devices, DVDs, or any other removable memory device capable of storing data. The port 226 electrically couples the data storage medium 228 to the game apparatus 200. Upon completing a game, players may load a new game from the storage device 222 or the storage media 228, displaying a new pattern of given solution indicia 214 and possible solution indicia 218 in the respective cells 212.

Figure 10:
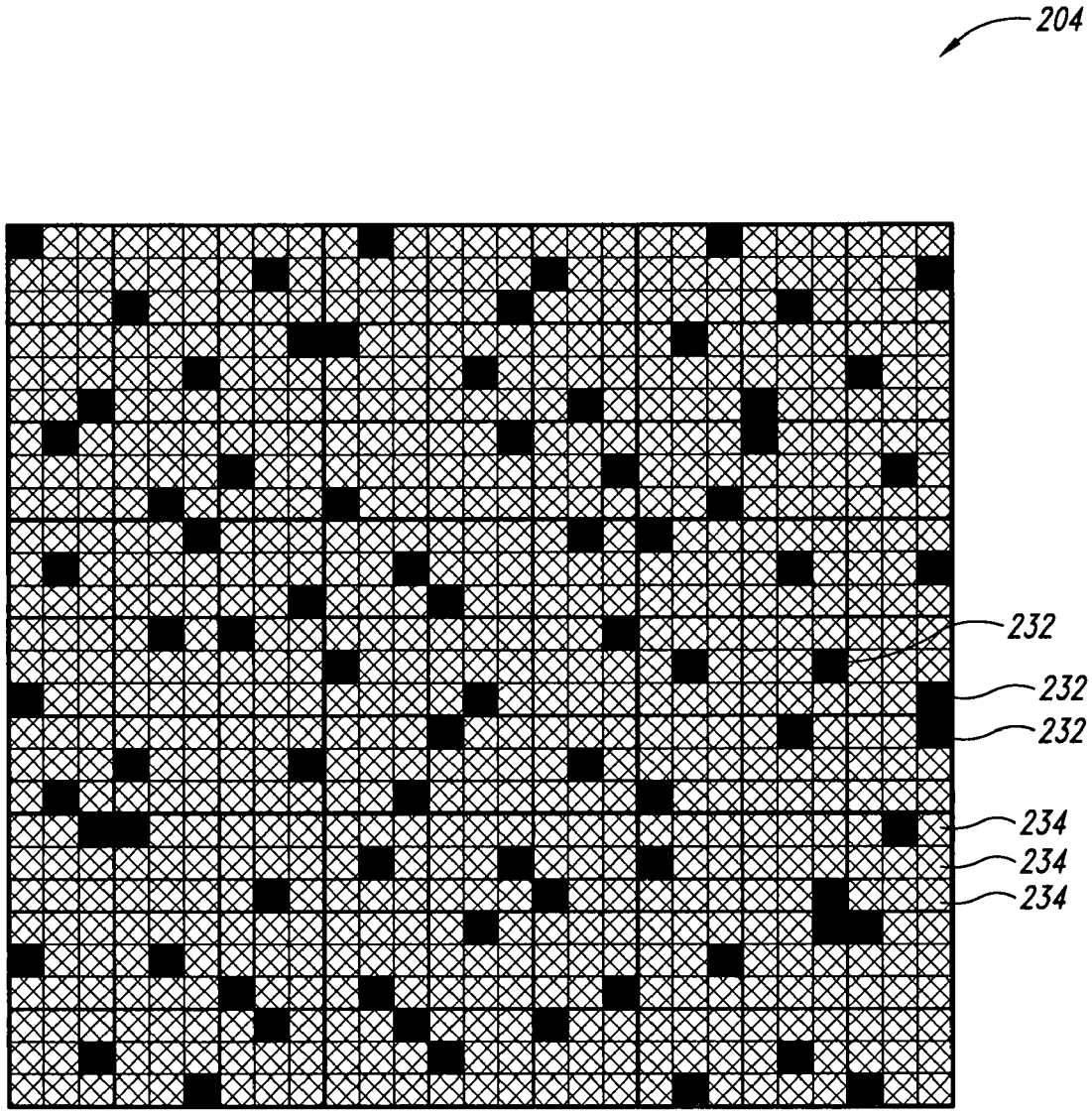
FIG. 10 is a plan view of the solution plane of FIG. 8 including a plurality of cells and sub-cells.
Figure 11:
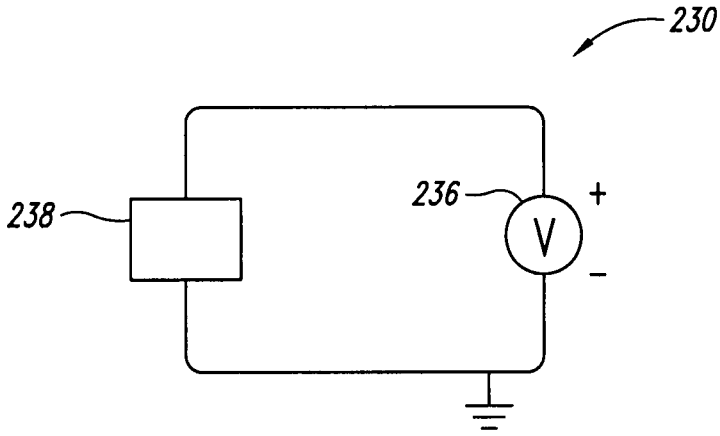
FIG. 11 is a block diagram of a circuit of respective sub-cells of FIG. 10.

Similar to the mechanical embodiments of the present invention, the players take turns speculating about the correct solution indicia 56 of the solution pattern 54 corresponding to the respective cells 212. As illustrated in FIG. 10, in the underlying solution plane 204, each sub-cell 216 can be electrically coupled to a circuit 230 (FIG. 11) to generate a first signal 232 or a second signal 234 in response to a selection by a player, the first signal 232 indicating a correct selection and the second signal 234 indicating an incorrect selection. As shown in FIG. 11, the circuit 230 includes a power-producing device 236 and a signal-producing device 238. The power-producing device 236 can be portable such as replaceable or rechargeable batteries, including lithium polymer batteries, solar energy panels, fuel cell modules, or any other source of energy that is portable. Examples of stationary power-producing devices 236 or energy sources include power outlets, stationary batteries, generators, or any other source of energy that is not portable.

Figure 12A:
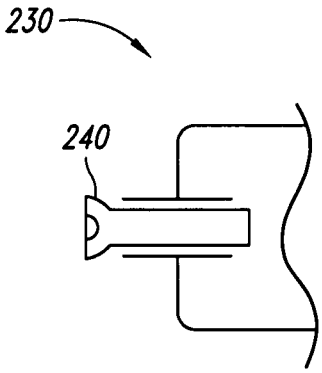
FIG. 12A is a block diagram of a circuit of the respective sub-cells of FIG. 10 including an audible device according to one aspect.

The signal-producing device 238 can include an audible device 240 such as a piezo speaker as illustrated in FIG. 12A. A solution program retrieved from at least one of the storage devices 222, 228 of the substrate member 224 can configure the circuit 230 such that the voltage supplied to the audible device 240 depends on whether a player has made a correct or an incorrect selection with respect to the solution indicia 56 of the solution pattern 54 assigned to the respective cells 212. Therefore, the audible device 240 can produce a distinct sound corresponding to the first signal 232, different from a sound that the audible device 240 can produce corresponding to the second signal 234 of the solution plane 204.

Figure 12B:
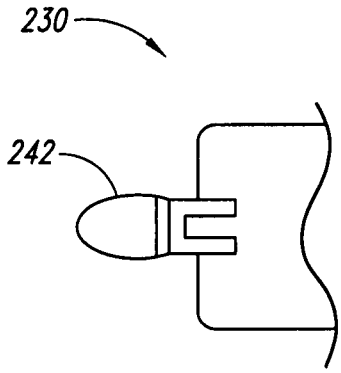
FIG. 12B is a block diagram of a circuit of the respective sub-cells of FIG. 10 including an illumination device according to another aspect.

Additionally or alternatively, the signal-producing device 238 of the circuit 230 may include an illumination device 242 such as at least one light emitting diode (LED) as illustrated in FIG. 12B. A solution program retrieved from at least one of the storage devices and/or media 222, 228 of the substrate member 224 can configure the circuit 230 such that the voltage supplied to the illumination device 242 depends on whether a player has made a correct or an incorrect selection with respect to the solution indicia 56 of the solution pattern 54 assigned to the respective cells 212. Therefore, the illumination device 242 can produce an illumination of a first intensity corresponding to the first signal 232, different from an illumination of a second intensity corresponding to the second signal 234 of the solution plane 204.

Figure 12C:
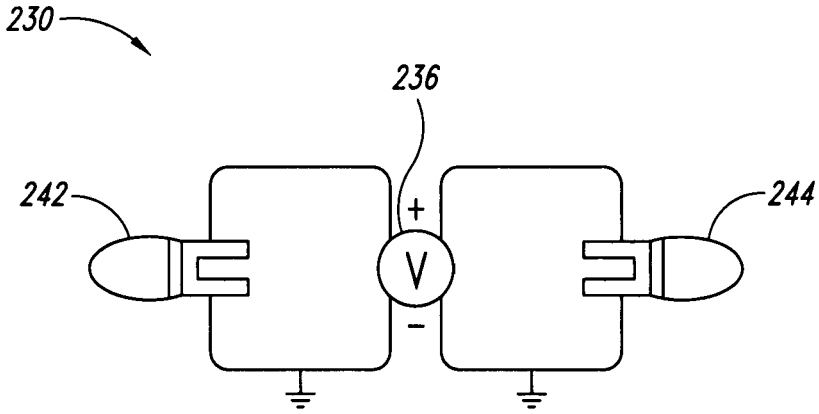
FIG. 12C is a block diagram of a circuit of the respective sub-cells of FIG. 10 including two illumination devices according to yet another aspect.

In another embodiment, the signal-producing device 238 of the circuit 230 may include a first illumination device 242 and a second illumination device 244 as illustrated in FIG. 12C. A solution program retrieved from at least one of the storage devices 222, 228 of the substrate member 224 can configure the circuit 230 to alternatively illuminate one of the illumination devices 242, 244 depending on whether a player has made a correct or an incorrect selection with respect to the solution indicia 56 assigned to the respective cells 212 in the solution pattern 54. The illumination devices 242, 244 may exhibit distinct colors such as green and red, corresponding to the first signal 232 and the second signal 234, respectively. Therefore, when a player correctly selects a sub-cell 216 of the playing plane 202, the first illumination device 242 illuminates, exhibiting the first signal 232 such as the color green, and alerting the players that a correct selection has been made.

Upon making a correct selection, the game piece 100 illustrated in FIG. 6 and bearing indicia 102 corresponding to the solution indicia 56 for the respective cell 212, may be placed on that cell 212. The game pieces 100 make it easier for players to identify the cells 212 for which the correct solution indicia 56 has been selected and to use these numbers as additional clues to develop the solution indicia 56 for the remaining cells 212.

Additionally or alternatively, the circuit 230 depicted in FIG. 12C may be configured to maintain the illumination device 242, 244 in a luminous state when a correct selection has been made. Therefore, the corresponding sub-cell 216 of the playing plane 202 exhibiting the correct solution indicia 56 will remain in a luminous state to make it easier for players to identify the cells 212 for which the correct solution indicia 56 has been selected and to use these indicia or numbers as additional clues to develop the solution indicia 56 for the remaining cells 212.

Figure 13:
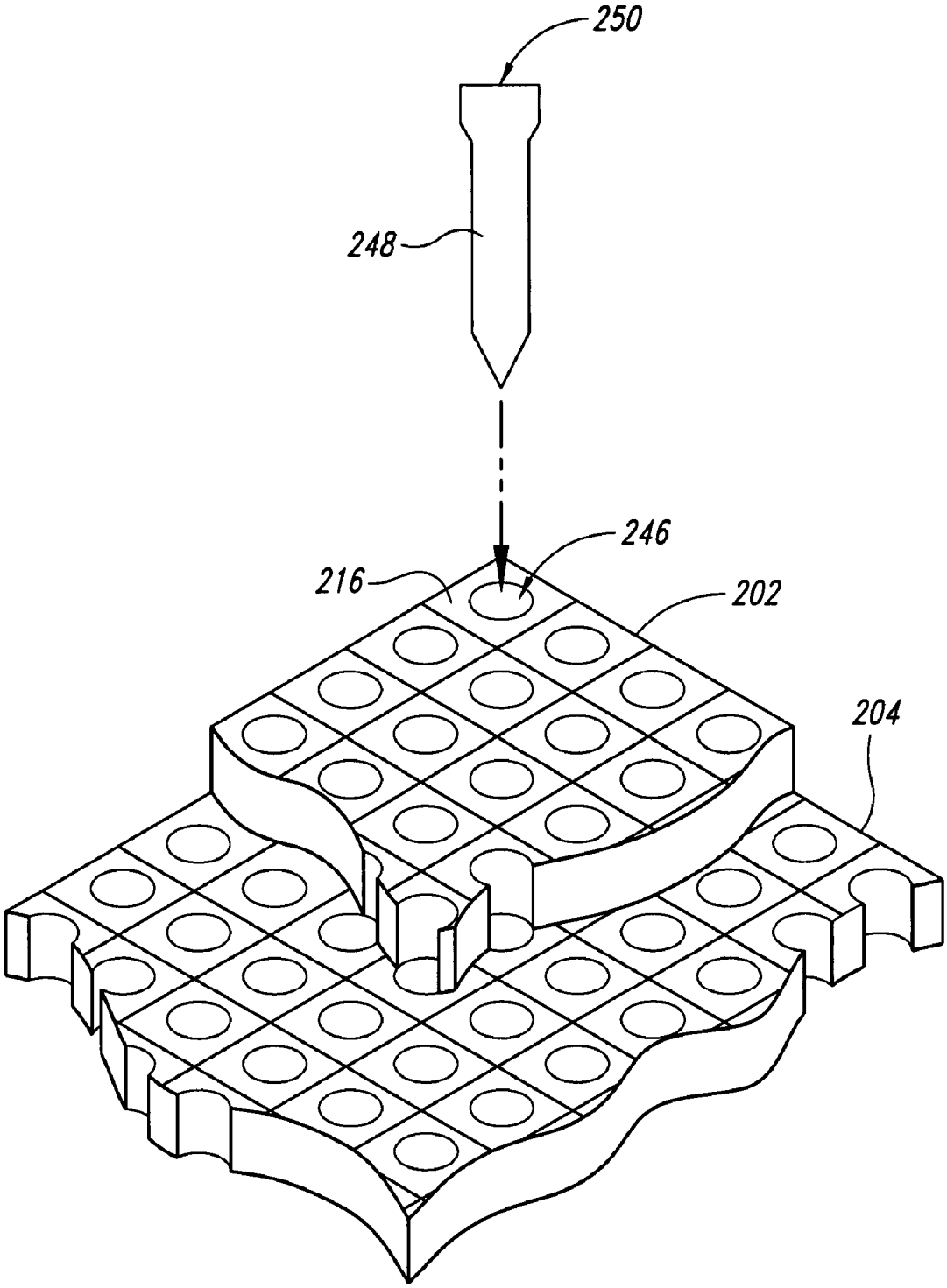
FIG. 13 is a partial isometric view of a game apparatus according still another embodiment of the present invention.

In yet another embodiment illustrated in FIG. 13, the sub-cells 216 of the playing plane 202 include apertures 246 adapted to receive a tool 248 that is adapted to communicate the first signal 232 or the second signal 234 of the solution plane 204 corresponding to a correct or an incorrect selection, respectively. In one embodiment, the tool 248 can include fiber optic material configured to carry an illumination from or to an external surface 250 of the tool 248. For example, in one embodiment, the first and the second signals 232, 234 can be illuminations of a first color and a second color, respectively, produced by an LED device positioned on the solution plane 204. The illuminations have an intensity or magnitude such that the illuminations are not visible through the playing plane 202 before the tool 248 is inserted in the respective apertures 246. Furthermore, the tool 248 can be made of glass, plastic, bundles of glass or plastic fibers such as fused fiber optic material. When the tool 248 is inserted in the apertures 246, the fiber optic material carries the respective illuminations toward the external surface 250 to communicate the first signal 232 or the second signal 234 to the players.

In embodiments in which the tool 248 includes fiber optic material, when ambient light is sufficient to travel through the tool 248, the LED lights can be eliminated or deactivated. The ambient light travels through the fiber optic material, reflecting an image of an underlying indicia corresponding to the first signal 232 or the second signal 234 toward the external surface 250 to communicate the corresponding first signal 232 or second signal 234. The indicia may include colors, alphanumeric characters, symbols, or any combination thereof.

In another embodiment, the tool 248 can include a magnifying device such as a magnifying glass at the external surface 250 of the tool 248 that visually communicates a signal substantially the same as the signal on the underlying solution layer 204, which is produced as described above.

Figure 12D:
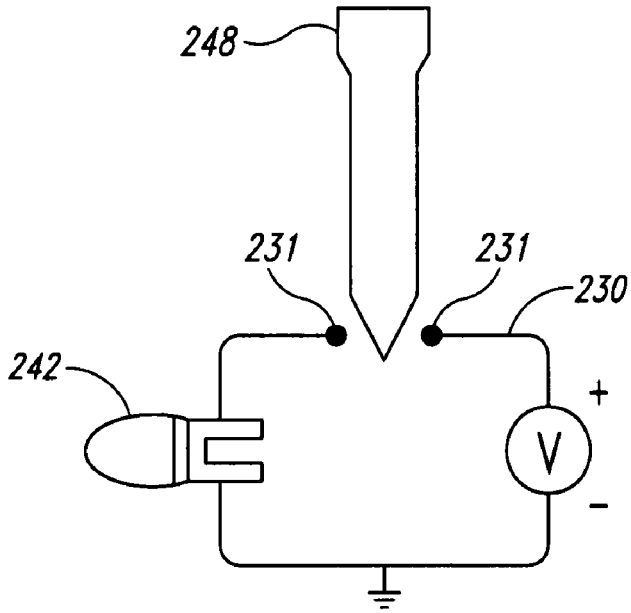
FIG. 12D is a block diagram of a circuit of the respective sub-cells of FIG. 10 according to still another aspect.

In yet another embodiment as illustrated in FIG. 12D, the tool 248 may be fabricated from an electrically conductive material and the circuit 230 includes exposed conductors 231. When the tool 248 is inserted in the apertures 246, the tool 248 closes the circuit 230 by touching the conductors 231, to produce the first signal 232 when a correct selection is made or the second signal 234 when an incorrect selection is made. As described above, a solution program stored in at least one of the data storage devices 222, 228 configures the circuit 230 to produce the appropriate signal 232, 234, depending on whether the selected solution indicia 218 included in the corresponding sub-cell 216 is the solution indicia 56 corresponding to the respective cell 212.

Additionally, or alternatively, known auto-sensory mechanism may be incorporated in electronic embodiments of the present invention so that a player can play the puzzle against a computer or with the aid of a computer giving the player hints by narrowing the possible solution numbers 218 to less than nine numbers per each cell 212.

Figure 14:
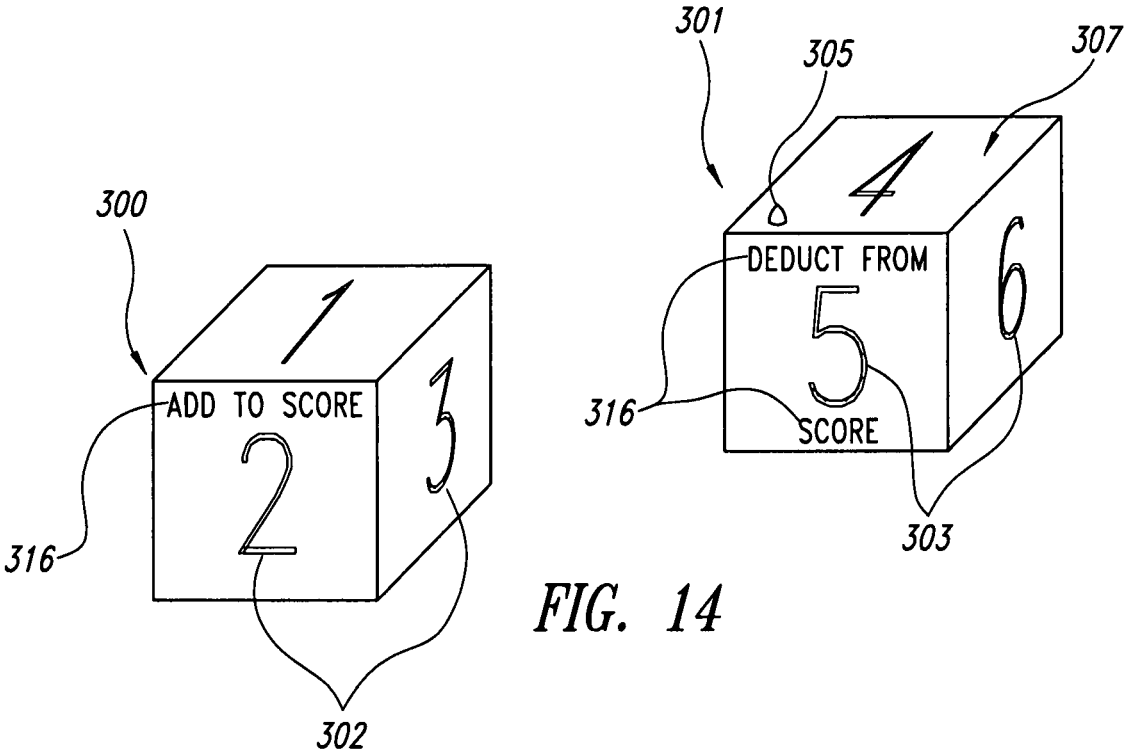
FIG. 14 is a an isometric view of first and second game pieces according to another embodiment of the present invention.

A further aspect of any of the embodiments described herein includes at least a first game piece 300 having distinct indicia 302 as illustrated in FIG. 14. A current player (i.e., the player whose turn it is to play) manipulates the game piece 300 such that the game piece 300 randomly displays one of the indicia 302. The displayed indicia 302 provides an indication of a first rule to be applied to a game parameter of the current player. In one embodiment, the indicia 302 can provide an indication of a positive score value to be added to the current player's score for making a correct selection. For example, the game piece 300 is a die or a pair of dice having a cubic shape with indicia 302 on external faces, which may include at least three distinct numbers on three distinct faces of each die. In such an embodiment, the current player rolls the dice and a total of the displayed numbers are the numbers of points the player will receive for making a correct selection.

Additionally, or alternatively, in yet a further aspect, any of the above embodiments may comprise at least a second game piece 301 having indicia 303 as illustrated in FIG. 14. The current player manipulates the game piece 301 such that the game piece 301 randomly displays one of the indicia 303. The displayed indicia 303 provides an indication of a second rule to be applied to a game parameter of the current player. In one embodiment, the displayed indicia 303 provides an indication of a negative score value for making an incorrect selection. For example, the game piece 301 may include a die, which is cubic and carries the indicia 303, which may be at least three distinct numbers on three distinct surfaces of the die or dice. In such an embodiment, the current player rolls the dice and the displayed number or numbers is the number of points deducted from the current player's score for making an incorrect selection.

In embodiments that include both the first and second game pieces 300, 301, the indicia 302, 303 on the game pieces 300, 301 may be substantially identical or different. Furthermore, instead of being cubic, the game pieces 300, 301 may comprise any other shape, for example octagonal. Alternatively, the game piece 300, 301 can be electronically activated. For example, the game pieces 300, 301 may comprise an activating trigger 305 to initiate a random or predetermined number-generating routine and display a resulting number on a surface 307 of the game piece 300, 301. In other electronic embodiments, the number may be generated by otherwise manipulating the game pieces 300, 301, such as shaking the game pieces 300, 301, to emulate a feel of rolling dice.

Figure 15:
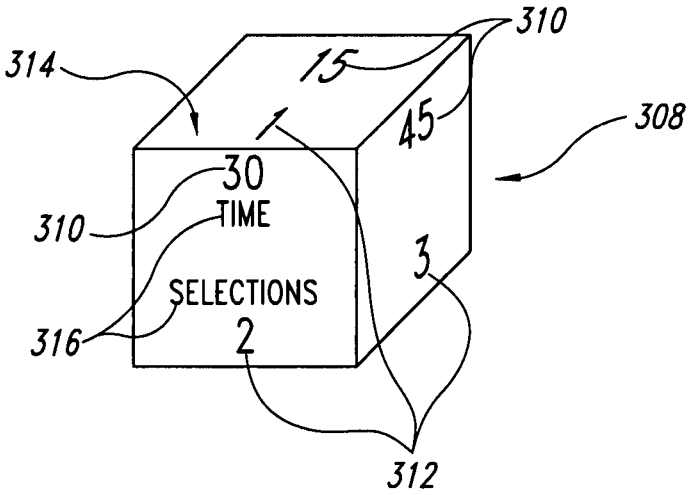
FIG. 15 is an isometric view of a third game piece according to yet another embodiment of the present invention.
Figure 16:
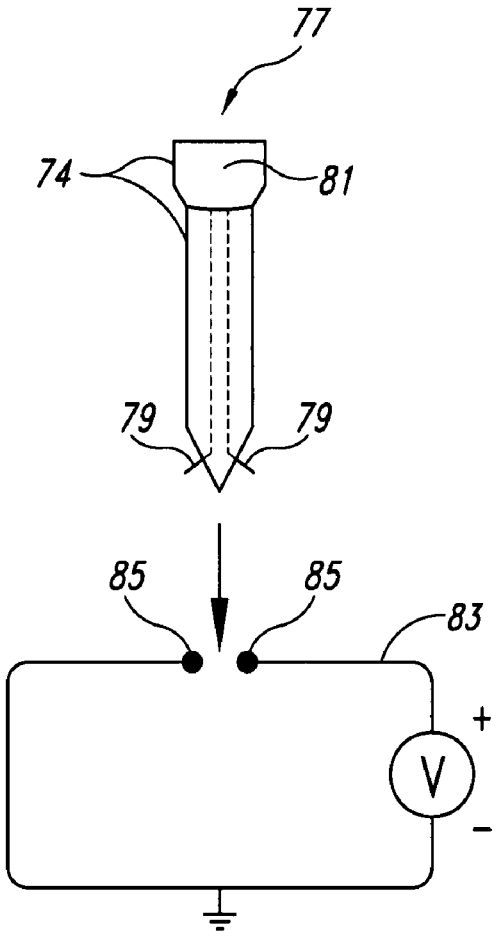
FIG. 16 is a block diagram of a circuit of respective sub-cells of FIG. 1 according to one aspect.

Additionally, or alternatively, in still further aspects, any of the above embodiments may comprise at least a third game piece 308 having at least a first indicia 310 as illustrated in FIG. 15. The current player manipulates the third game piece 308 such that the third game piece 308 randomly displays one of the first indicia 310. The displayed first indicia 310 can provide a third rule that affects at least one other game parameter of the current player. For example, the first indicia 310 may provide an indication of a time duration, which the current player may consume while making a selection.

In the illustrated embodiment of FIG. 15, the third game piece 308 includes a die, which is cubic and carries the first indicia 310. The first indicia 310 includes at least three distinct numbers such as the numbers 15, 30, and 45, on distinct sides of the dice. The current player rolls the die and the displayed number can be the number of seconds the player has to make a selection.

In one embodiment, at least one game piece, such as the third game piece 308 illustrated in FIG. 15, may further comprise additional indicia, such as at least a second indicia 312 that provides an indication of a fourth rule on the same side of the third game piece 308 that carries the first indicia 310. In this embodiment, each surface of the dice carries at least one group of indicia, each group including at least the first indicia 310 and the second indicia 312. The second indicia 312 can be a number that represents the number of selections a player may make. For example, in an embodiment having a first game member 12 as illustrated in FIG. 2 and having the third game piece 308 of FIG. 15, the second indicia 312 can be an indication of a quantity of cell selections or sub-cell selections the current player can make during the time duration discussed above.

In the context of the embodiment in FIG. 2, the quantity of selections may be limited to a number of cells 22 per master grid 20, a number of sub-cells 58 per a cell 22, or a number of cells 22 per a sub-grid 52, or any combination thereof. Therefore, in embodiments where each side of the die includes first and second indicia 310, 312, two rules may apply to the current player. For example, in the illustrated embodiment of FIG. 15, the first indicia 310 on the displayed surface 314 is the number 15 and the second indicia 312 is the number 1. Accordingly, this combination yields 15 seconds for the current player to make one selection.

Subsequently, the current player can optionally mark the selections on the first game member 12, using a writing tool, such as the writing tool 106 illustrated in FIG. 7. Upon expiration of the time duration, the player can determine correctness of the selections according to any of the embodiments described herein. When multiple players are involved, the players can use writing tools 106 respectively having different colors to not confuse the markings of one player for the markings of another player.

Additionally, in any of the embodiments described herein other configurations are possible to generate the first and second signals respectively indicating whether a correct or an incorrect selection has been made. For example when determining the correctness of the selections, in an additional aspect of the illustrated embodiment of FIGS. 1-4, the sub-cells 78 of the third game member 16, which carry the solution indicia 80 for the corresponding cell 22 of the first game member 12, include an electrically conductive material. Furthermore, the selection pieces 74 include at least one illumination device 81 to shine light through an exposed surface 77 of the respective selection pieces 74, the exposed surface 77 being visible to the players when the respective game pieces are inserted in the corresponding openings 37 (FIG. 1). As illustrated in FIG. 13, the illumination device 81 is configured to electrically couple to a circuit 83 via electrical contacts 79. The electrical contacts 79 are exposed and positioned toward a portion of the selection piece 74 that is insertable in openings 37. The circuit 83 includes exposed conductors 85 positioned in the corresponding opening 37, the conductors 85 being configured to receive and touch the electrical contacts 79 when the selection piece 74 is inserted in the opening 37. When the conductors 85 touch the electrical contacts 79, the circuit 83 closes and the illumination device 81 is illuminated. Accordingly, the circuit closes when a player inserts the selection piece 74 in the openings 37 corresponding to the solution sub-cells (i.e., the sub-cells 78 carrying the indicia 80). Once the circuit 83 closes, the illumination device 81 illuminates, indicating a correct selection has been made.

One of skill in the art will appreciate these and other variations that can be made to embodiments of the game apparatus 10, 90, 200 without deviating from the scope of the present invention. For example, extra points can be awarded to a player who correctly selects a majority of cells 22, 212 per each sub-grid 52, 210 and/or per the master grid 20, 206. Additionally, or alternatively, extra points may be awarded to a player who correctly selects a maximum number of cells 22, 212 consecutively situated in a column or a row of the master grid 20, 206. Other rules and provisions for extra points are possible. For example, extra points may be awarded to a player who makes a correct selection for a last unresolved cell 22, 212 in one of the sub-grids 52, 210.

Additionally, different cells 22, 212 or sub-grids 52, 210 may be assigned different points or a distinct multiple factor. When the players make a correct cell selection or complete a sub-grid 52, 210, they are awarded points or their points are multiplied based on the points or multiple factors assigned to the different cells 22, 212 or sub-grids 52, 210.

As illustrated in FIGS. 14 and 15, the first, second, and third game pieces 300, 301, 308 may also include printing 316 on at least one surface thereof to indicate the game parameter that is affected by the randomly displayed indicia 302, 303, 310, 312 after the current player manipulates the game pieces 300, 301, 308. In other embodiments, the game pieces 300, 301, 308 may include distinct features, with each feature assigned to respective game parameters that are affected by the randomly displayed indicia. For example, the game pieces 300, 301, 308 may include distinct colors associated With distinct game parameters, respectively. Alternatively, the game pieces may include distinct shapes associated with distinct game parameters, respectively. Other distinctions are possible.

In this disclosure, examples of game parameters that can be affected by the randomly displayed indicia on the game pieces 300, 301, 308 have been described. However, one of ordinary skill in the art will appreciate that these or other game pieces may be utilized to affect other game parameters or include indicia other than numbers. For example, other game pieces may carry letters or words conveying additional restrictions or rules, such as the current player losing a turn or gaining a turn, the score of the current player multiplying by a factor if the current player's next speculation identifies the correct sub-cell for the corresponding cell, or any other rule affecting any other parameter. In this manner the winner of the game, will not be certain until the game ends and the game is more challenging.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An apparatus for playing a board game, comprising:

a playing game member having a master grid with a plurality of cells arranged in columns and rows, wherein the master grid is subdivided into sub-grids, each sub-grid having a number of cells equal to the number of columns in the master grid, each cell divided into a number of sub-cells equal to the number of columns in the master grid, and each sub-cell assigned a distinct indicia;

a solution game member having indicia corresponding to respective cells of the playing game member, the solution game member positioned with respect to the playing game member to substantially align the indicia with corresponding cells of the playing game member, the indicia providing an indication of correctness of a user-proposed solution; and an intermediate game member having a plurality of apertures respectively aligned with the sub-cells of the playing game member, the intermediate game member positioned between the playing game member and the solution game member, the playing, solution, and intermediate game members removably secured to each other.

2. The apparatus of claim 1, further comprising:

at least a first game piece not connected to the playing and solution game members and configured to be manually manipulated, the first game piece carrying at least two distinct indicia and adapted to randomly display at least one distinct indicia in response to a manipulation of the first game piece for providing an indication of a first rule of play applicable to a first game parameter of a current player.

3. The apparatus of claim 2 wherein the first game piece includes a cubic structure having distinct surfaces respectively carrying a plurality of distinct indicia.

4. The apparatus of claim 2, further comprising:

at least a second game piece not connected to the in and solution game members and configured to be manually manipulated, the second game piece carrying at least two distinct indicia and adapted to randomly display at least one distinct indicia in response to a manipulation of the second game piece for providing an indication of at least a second rule of play applicable to at least one of the first game parameter and a second game parameter of a current player.

5. The apparatus of claim 4 further comprising:

printing on at least one of the first game piece and the second game piece wherein the printing defines the first and second game parameters as respectively comprising at least one of a score of the current player, a quantity of opportunities afforded the current player for making the user-proposed solutions, and a duration of time afforded the current player for making the user-proposed solutions.

6. The apparatus of claim 1, further comprising:

at least one selection piece insertable in the apertures of the intermediate game member; and at least one mounting device configured to hold the intermediate game member, the playing game member, and the solution game member in a stacked configuration wherein a surface of the playing game member is contiguous to a surface of the intermediate game member, and the solution game member is revealably concealed by at least the playing game member such that the selection piece is insertable in a respective aperture of the intermediate game member to reveal an indicia on the solution game member associated with a sub-cell of the playing game member aligned with the respective aperture.

7. The apparatus of claim 6 wherein each cell of the solution game member comprises one sub-cell configured to display a first indicia and a remainder of sub-cells configured to display a second indicia, the first indicia indicating a correct selection and the second indicia indicating an incorrect selection, the one sub-cell corresponding to a playing game member sub-cell indicia that is a solution indicia for the corresponding cell, each solution indicia occurring once in each sub-grid, row and column of the master grid.

8. A game apparatus comprising:

a playing plane having a master grid with a plurality of cells arranged in columns and rows, wherein the master grid is subdivided into sub-grids, each sub-grid having a number of cells equal to the number of columns in the master grid, each cell divided into a number of sub-cells equal to the number of columns in the master grid, and each sub-cell assigned a distinct indicia;

a solution plane having a plurality of cells corresponding to the respective cells of the playing plane, the solution plane configured to provide an indication of correctness of a user-proposed solution for a respective cell of the playing plane, each cell of the solution plane divided into a plurality of sub-cells corresponding to respective sub-cells of the playing plane, each sub-cell associated with an electric circuit to generate a selection signal comprising one of a first and a second signal, the first signal indicating a correct selection and the second signal indicating an incorrect selection;

a display device associated with the playing plane and configured to display indicia on the playing plane; and at least one data storage device electrically coupled to the game apparatus.

9. The apparatus of claim 8 wherein each cell of the solution plane comprises one sub-cell associated with a circuit to generate the first signal, the sub-cell corresponding to a playing plane sub-cell indicia that is a solution indicia for the corresponding cell, each solution indicia occurring once in each sub-grid, row and column of the master grid.

10. The apparatus of claim 8, further comprising:

at least one selection piece configured to facilitate selecting a sub-cell.

11. The apparatus of claim 8, further comprising:

a device configured to communicate the first and second signals including at least one illumination device, the first and second signals including illuminations of a first and a second color or of a first and a second intensity.

12. The apparatus of claim 9 wherein the one sub-cell of each cell comprises a circuit having an exposed conductor and the selection pieces each comprise at least one illumination device toward an exposed surface thereof, each selection piece having an exposed electrical contact positioned toward a portion of the selection piece, which is insertable in the apertures, the electrical contact being configured to touch the exposed conductor for electrically coupling the illumination device to the circuit, the circuit closing upon insertion of the selection piece in the aperture corresponding to the solution sub-cell for illuminating the illumination device to generate the first signal.

13. The apparatus of claim 8, further comprising:

at least one port and at least one removable memory media configured to be removably coupled to the at least one port.

14. The apparatus of claim 8 wherein the data storage device is integrally coupled to a portion of the apparatus.

15. The apparatus of claim 8, further comprising:

a device configured to communicate the first and second signals including at least one of a fiber optic device and a magnifying device configured to display or relay the first and second signals.

16. The apparatus of claim 8, further comprising:

a device configured to communicate the first and second signals including at least one audible device.

17. The apparatus of claim 1, further comprising:

a plurality of game pieces respectively marked with distinct indicia substantially similar to the respective distinct indicia of the sub-cells in a sub-grid of the playing game member, each game piece being selectively positionable on respective cells of the playing game member to indicate the solution indicia for the corresponding cell.

* * * * *